United States Patent [19]

Hayes

[11] Patent Number: 4,932,527

[45] Date of Patent: Jun. 12, 1990

[54] PACKAGE FOR STORING AND HEATING LIQUIDS

[76] Inventor: Charles S. Hayes, 1634 E. Jefferson Blvd., South Bend, Ind. 46617

[21] Appl. No.: 181,559

[22] Filed: Apr. 14, 1988

Related U.S. Application Data

[63] Continuation-in-part of Ser. No. 897,583, Aug. 18, 1986, Pat. No. 4,745,248.

[51] Int. Cl.[5] ..... B65D 25/28

[52] U.S. Cl. ..... 206/428; 206/541; 220/94 R

[58] Field of Search ..... 206/162, 201, 203, 427, 206/428, 432, 541, 542; 220/3.1, 23, 23.83, 85 H, 94 B, 94 R

[56] References Cited

U.S. PATENT DOCUMENTS

| | | | |
|---|---|---|---|
| 2,647,653 | 8/1953 | Dube | 220/410 |
| 3,071,282 | 1/1963 | Walters | 220/412 |
| 3,401,535 | 9/1968 | Palmer | 220/410 |
| 3,591,768 | 7/1971 | Torres | 220/412 |
| 3,848,766 | 11/1974 | Ganti et al. | 220/412 |
| 4,119,248 | 10/1978 | Butler et al. | 220/412 |
| 4,228,908 | 10/1980 | Tweeton | 220/412 |
| 4,286,714 | 9/1981 | Zdarsky et al. | 229/52 A |
| 4,368,819 | 1/1983 | Durham | 220/412 |
| 4,541,540 | 9/1985 | Gretz et al. | 220/412 |
| 4,673,117 | 6/1987 | Calton | 220/3.1 |

FOREIGN PATENT DOCUMENTS

| | | | |
|---|---|---|---|
| 2550517 | 2/1985 | France | 220/3.1 |
| 1382842 | 2/1975 | United Kingdom | 206/432 |

*Primary Examiner*—Jimmy G. Foster

*Attorney, Agent, or Firm*—Polster, Polster and Lucchesi

[57] ABSTRACT

A system for providing heated liquids includes a container for storing and heating a plurality of individual liquid receptacles. The container is of a two part design and the container parts are held in integral relationship by an enclosure or wrapper. The enclosure and container together provide a handle for the system. The system is intended to be heated in a method which permits the temperature of the liquid to be raised to a temperature which is held by the package over a substantial period of time.

10 Claims, 3 Drawing Sheets

FIG. 3.
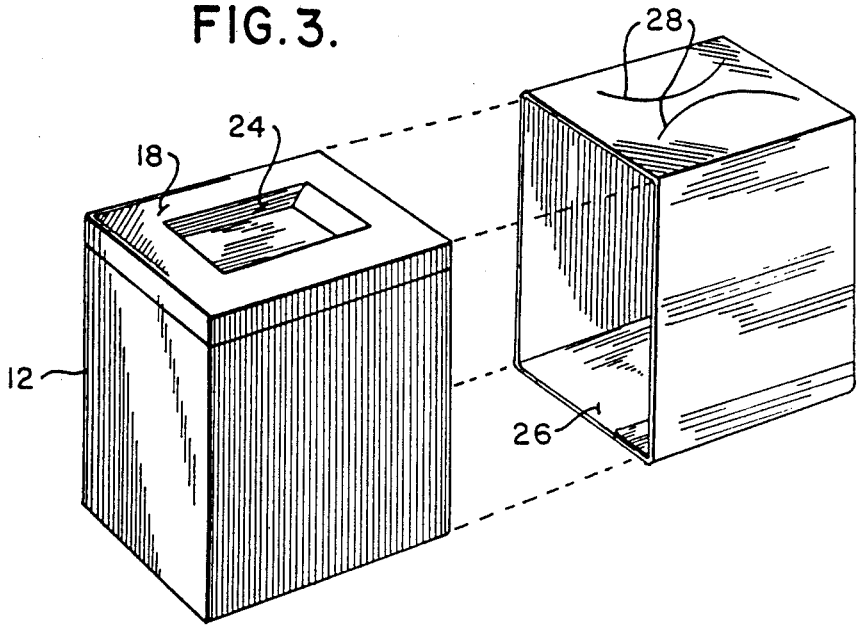
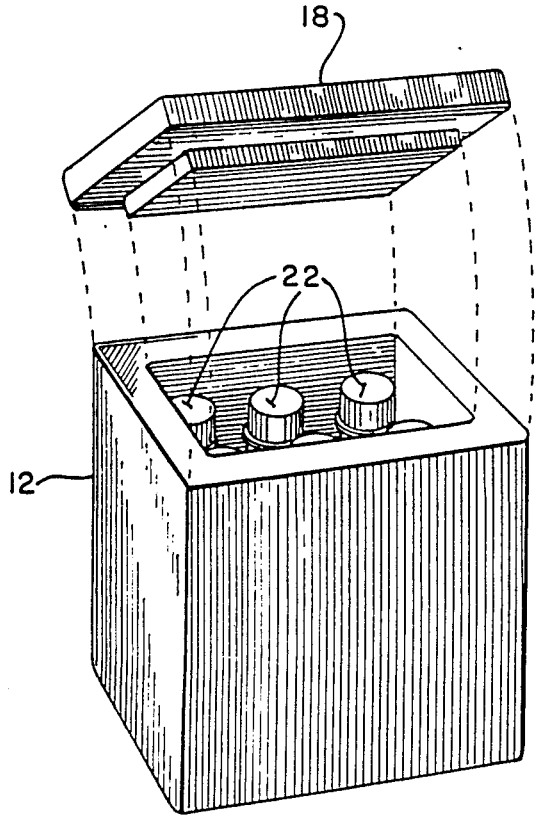
FIG. 4.

PACKAGE FOR STORING AND HEATING LIQUIDS

Cross-Reference to Related Application

This is a continuation-in-part of application Ser. No. 897,583, filed Aug. 18, 1986, U.S. Pat. No. 4,745,248.

Background of the Invention

This invention relates to a packaging system, product and method of heating the product so that the temperature of the product is maintained over a substantial period of time while the product itself can be handled and distributed.

I have for some time thought it desirable to provide consumers with heated liquid refreshment, for example, while they are engaged in winter activities, such as skiing or ice skating, or observing sporting events, such as football games or other cold weather activities. Several problems are encountered in trying to mass market a product in a cold weather environment. For example, the first problem to be encountered is that the product must be capable of being maintained at a desired heated temperature for a substantial period of time if wide scale distribution to consumers is to be achieved. Secondly, it is important to have a convenient package that can be distributed widely. In this regard, the package must be easy to handle, both for the person selling the product and the ultimate consumer.

Previous methods and packages for maintaining elevated temperatures in stored liquids were very inefficient. Such packages usually involved heating the liquid and then transferring the liquid receptacle to an insulated storage container. Heat loss during transfer and the decreased temperature of the storage container causes stored liquid to cool too rapidly.

A number of containers have been devised which permit microwave heating of foods, solids or liquids, Among those of which I am aware, besides those patents cited in the above noted application of which this application is a continuation-in-part, include U.S. Pat. No. 4,585,915, issued Apr. 29, 1986, which describes a relatively complicated container generally employed for solid foods as opposed to individual liquid receptacles. U.S. Pat. No. 4,495,392, issued Jan. 22, 1985, illustrates an improved microwave crock pot. U.S. Pat. No. 4,490,597, issued Dec. 25, 1984, shows a pressure compensating device for use in microwave ovens. U.S. Pat. No. 4,478,349, issued Oct. 23, 1984, illustrates a double walled cooking utensil for microwave ovens. U.S. Pat. Nos. 4,416,906 and 4,416,907, issued Nov. 22, 1983 illustrates a disposable microwave food preparation heating container which attempts to solve the problem of uneven heating in using microwave heating. U.S. Pat. No. 4,020,310 issued Apr. 26, 1977, describes a method and apparatus for heating foods transported in containers, particularly for hospitals. U.S. Pat. No. 3,941,967, issued Mar. 2, 1976, shows a device for scorching the surface of the material to be cooked without excessively heating the interior of the material. Also noted of interest are U.S. Pat. No. 4,523,078, issued June 11, 1980, which teaches a portable warming container for transporting infusions and U.S. Pat. No. 3,585,357 which teaches an electric oven for hair rollers.

While the prior art in general and the specific patents in particular work for their intended purposes, they do not address the problem or offer a solution to the problem of providing an easy to handle, highly marketable, individual liquid serving container as described hereinafter.

One of the objects of this invention is to provide an improved method of maintaining the temperature of heated liquids.

Another object of this invention is to provide a method of heating liquid in containers which is efficient and economical.

Another object of this invention is to provide for a container which stores heated liquids and is easy to carry and distribute.

Another object of this invention is to provide a packaging system for individual servings of refreshment which firmly holds and supports the individual servings during transportation and heating.

Another object of this invention is to provide a packaging system which includes a wrapper or envelope for holding the container in integral relationship, which envelope may incorporate advertising or labeling information.

Another object of this invention is to provide a packaging system in which an envelope wrapper for the package cooperates with the package to form a handle for the system.

Another object of this invention is to provide a low cost, disposable packaging system for individually contained servings of a liquid.

Other objects of this invention will become apparent to those skilled in the art in light of the following description and accompanying drawings.

Summary of the Invention

In accordance with this invention, generally stated, a packaging system for a heating method is designed to provide individual servings of a heated beverage. In the preferred embodiment, the package is a two-piece container locked together by an envelope for wrapper. The envelope together with the container form a handle for the package. The package is shaped to provide easy stacking and heating. The container includes a lower packaging part adapted to receive a plurality of individual serving bottles of a beverage. The package is such that the individual serving bottles are maintained positionally and firmly within the container so as to prevent movement of the bottles, while maintaining an integral heat transfer relationship within the package. The method of this invention involves placing the individual liquid receptacles into the container prior to heating and heating the individual liquid receptacles in the container from a heat source positioned externally of the container. After heating, the storage container is allowed to set for a short period of time to equalize the internal temperature of the package where the liquid receptacles are located.

Brief Description of the Drawings

In the drawings.

FIG. 3 is a perspective view of the insulated container and wrapper member shown in separate form;

FIG. 4 is a perspective view of the insulated container with its top removed;

Description of the Preferred Embodiment

The preferred method and device described herein are not intended to be exhaustive or to limit the invention to the precise form or steps disclosed. They are chosen and described to illustrate the principles of the invention and its application and practical use to thereby enable others skilled in the art to utilize the invention.

Figure 1:
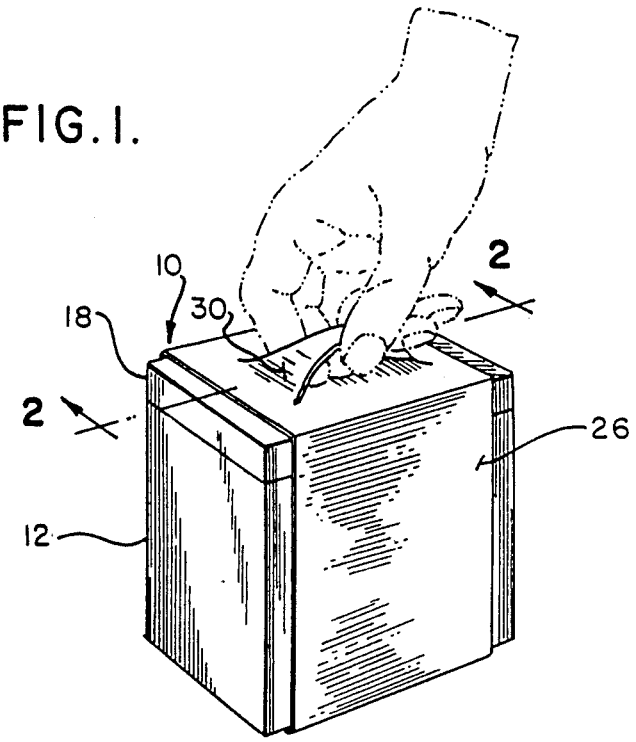
FIG. 1 is a view of perspective of one illustrative embodiment of insulated beverage container of this invention.
Figure 2:
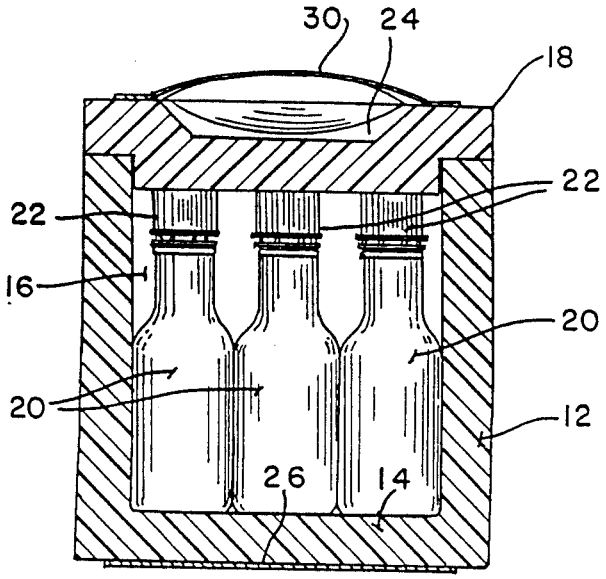
FIG. 2 is a sectional view taken along the line 2—2 of FIG. 1.

Referring now to the drawings, reference numeral 10 refers generally to the insulated container of this invention. Container 10 includes an integral continuous side wall 12 and a bottom wall 14 constructed to form a storage compartment 16. A removable top 18 forms a part of the container 10 and covers and seals storage compartment 16. Container 10 is preferably formed of lightweight insulative material such as expanded polystyrene. As shown in FIGS. 2 and 4, a plurality of receptacles such as bottles 20 may be stored within the storage compartment 16. Bottles 20 preferably are sealed by a screw-on lid 22 and may contain a liquid for human consumption. In the embodiment shown in FIGS. 1 through 4, removable container top 18 has a recess 24 formed in its outer surface and the bottom portion thereof is shaped to mate and nest with the upper portion of side wall 12 and can be so dimensioned that the bottom or inner face of the nesting bottom portion rests proximate the upper face of screw-on lid 22 to firmly hold the bottles 20 in position in storage compartment 16. Wrapper member 26 includes arcuate slits 28 which are positioned side-by-side adjacent top recess 24 to form a handle 30 and allow container 10 to be carried in a tote fashion as shown in FIG. 1. Wrapper member 26 is of sufficient strength to permit container 10 with bottles 20 to be carried conveniently from an externally positioned source, for example, by microwave energy to a desired temperature for a predetermined time period. The now heated contents of container 10 are allowed to set at ambient temperature until the internal temperature of the liquid in bottles 20 has equalized. The insulative nature of container 10 maintains the desired liquid temperature in bottles 20 until the container is opened and the liquid is consumed. The following example is illustrative of the process.

EXAMPLE

A container was constructed according to the principles outlined above (polystyrene walls 0.625 inches thick). Six sealed bottles containing a buttered rum beverage were placed into the container storage compartment and the compartment sealed by the container top. The container and bottles were then placed in a 500 watt microwave oven and heated at full power for two minutes. The container was removed with the temperature of the liquid in the bottles observed to be 175° F. After setting at ambient temperature (approximately 68° F.) for ninety minutes, the bottles were removed from the container with their liquid temperature recorded to be 135° F.

A second embodiment of my invention is shown in FIGS. 4 through 8. Like reference numerals have been employed where appropriate. Again, the container 10 includes a lower packaging part 40. The lower packaging part 40 includes side walls 42, 44, 46, and 48 and a bottom wall 50. The side and bottom walls preferably are integrally constructed from polystyrene material. Each of the side walls have a material thickness M, which defines the receptacle 16. The material thickness M has a plurality of lands 52 formed in it, which delimit grooves 54. The grooves 54 are dimensionally sized so as to receive the outer dimension or silhouette of the bottles 20. The material thickness of the side wall 48, in the embodiment illustrated, does not have a land 52 formed in it. Rather, the curvatures of the bottles 20 delimits a receptacle area 56 for a plurality of drinking straws, not shown. If desired, the bottom wall 50 may have a cut out or recess 58 formed in it, to receive the ends of the drinking straws. The straws are designed to extend partially into the top 18 so that they are held against movement when the top is positioned in the manner shown in FIG. 8.

Figure 8:
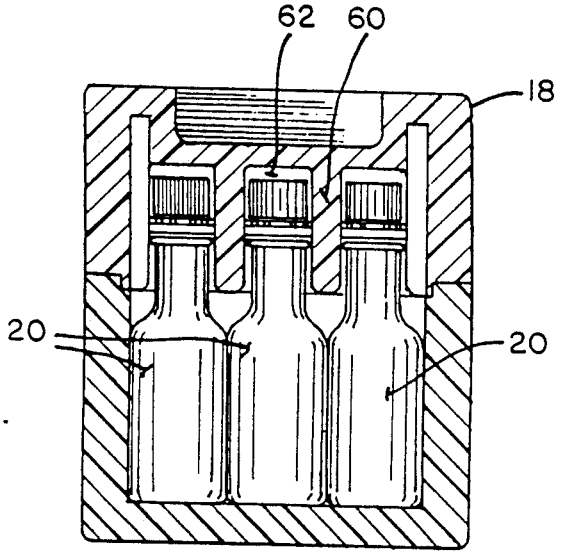
FIG. 8 is a sectional view taken along 8—8 of FIG. 6.
Figure 5:
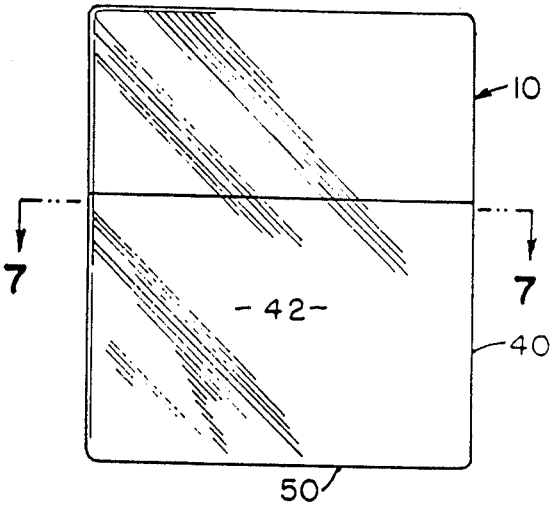
FIG. 5 is a view in side elevation of a second illustrative embodiment of container of this invention.
Figure 7:
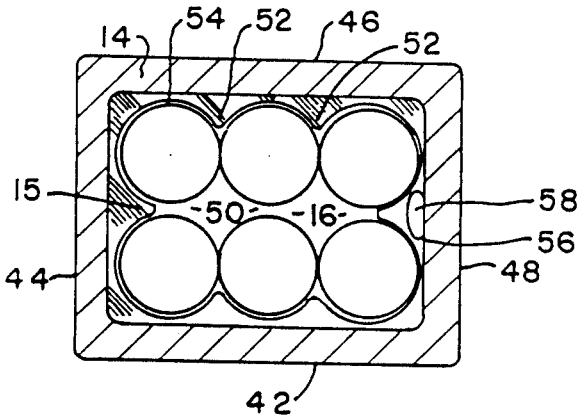
FIG. 7 is a sectional view taken along line 7—7 of FIG. 5.
Figure 6:
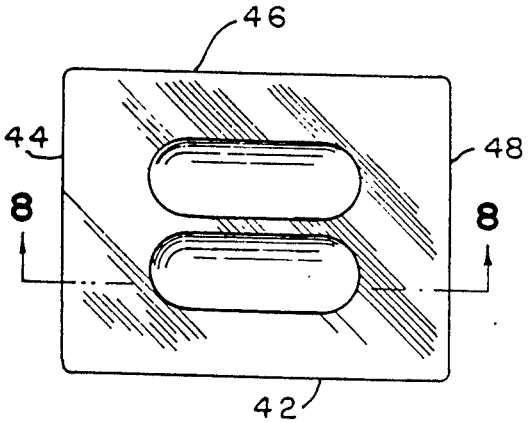
FIG. 6 is a top plan view thereof.
Figure 9:
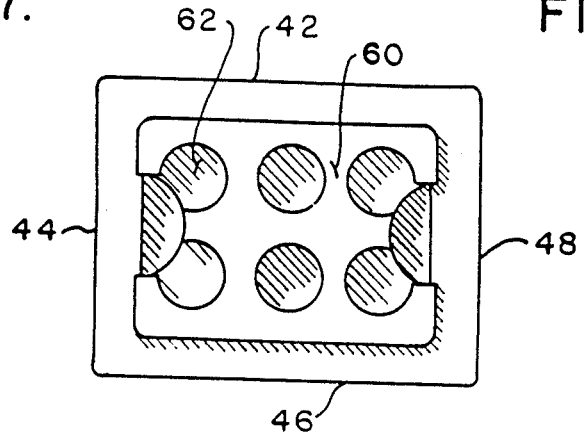
FIG. 9 is a bottom view of the removable top of the beverage container.

Referring now to FIGS. 8 and 9, the top 18 which also has the bottom thereof shaped to mate and nest with the upper portion of side wall 12 which has similarly numbered side walls and which is provided with similar recesses (not numbered) includes a plurality of projections 60 which define a plurality of top holders 62. As their name indicates, the holders 62 are sized to receive the tops of the bottles 20. The combination of the holders 62 and the lands 52 hold the bottles 20 within the receptacle 16 and prevent extraneous movement of the bottles 20 during shipping, handling and heating of the container 10. The nestled relationship of the bottles 20 also permit heating and equalization of the liquid in the bottles.

The bottles 20 themselves may be designed in a variety of ways. I find it convenient to use bottles similar to "airline miniatures" for holding the liquid to be heated, but other designs can be employed, if desired.

In use, the container 10 is particularly suited to wide and easy distribution. Initially, the containers can be stocked in large shipping lots. After receipt, the individual containers are easy to handle at the customer distribution level, making them particularly attractive in a variety of commercial applications.

Numerous variations, within the scope of the appended claims, will be apparent to those skilled in the art in light of the foregoing description and accompanying drawings. Thus, while the container 10 is illustrated with 6 of the bottles 20, fewer or larger numbers of bottles may be utilized, if desired. I have found that a rectangular container 10 is the most convenient one to generally handle, but other shapes may be employed, if desired. The thickness M of the side walls and top may vary in other embodiments of the invention. These variations are merely illustrative.

Having thus described the invention, what is claimed and desired to be secured by Letters Patent is:

1. A system for providing storage and heating for a plurality of individual liquid receptacles, comprising:

a container including a lower enclosure part, said lower enclosure part including a plurality of side walls and a bottom wall delimiting an open mouth receptacle part therein; a separable top having a material thickness with a groove formed therein, the top, adapted to matingly close the open top of said container to firmly hold said liquid receptacles in position;

a bottom portion which snuggly nests with said lower enclosure part with the lower face of the top proximate the upper faces of said liquid receptacles; and, an envelope wrapper for said top and bottom enclosure, said envelope adapted to receive said container and maintain said top and lower enclosure locked together, said envelope having a handle formed in it, said handle being aligned with the groove in said top.

2. The system of claim 1 wherein said side walls have a material thickness, at least two of said side walls have a plurality of lands and grooves formed in them, said grooves being sized to receive at least a part of the silhouette of individual ones of said liquid receptacles.

3. The system of claim 1 wherein said top has a plurality of fingers formed in it, defining a plurality of holders, said holders being sized to accept a portion of the individual ones of said liquid receptacles.

4. The system of claim 1 wherein at least one of said top and said bottom walls has a cutout formed in it for receiving a plurality of drinking straws, and a plurality of drinking straws in said container.

5. The system of claim 1 wherein said container is constructed from an insulative material, and said side walls and said bottom walls are integrally formed with one another.

6. The system of claim 1 wherein said wrapper is constructed from a cardboard material.

7. The system of claim 1 wherein said wrapper has at least one plain side for advertising indicia.

8. A package for holding liquid receptacles heated insitu, comprising:

a container, said container having a lower packaging part arranged to define an open enclosure, and a separable top adapted to close said open enclosure, each of said lower packaging part and top being constructed from an insulative material having a predetermined thickness, the material thickness of said lower packaging part housing a plurality of lands and grooves formed in it, said separable top having an outwardly facing groove formed in the material thickness thereof;

a plurality of bottles in said open enclosure, at least some of said bottles having an exterior shape sized for reception in the grooves of said lower packaging part; and a wrapper adapted to close said top and lower packaging part, said wrapper having a handle formed in it and positioned to be aligned with the grove of said top.

9. The package of claim 8 wherein said container is constructed from polystyrene.

10. The package of claim 8, further including a plurality of drinking straws positioned in said open enclosure.

* * * * *